United States Patent [19]

Day

[11] Patent Number: 4,865,202

[45] **Date of Patent: * Sep. 12, 1989**

[54] MOBILE EXTRA DISPLAY MODULE

[75] Inventor: Gerald G. Day, Marietta, Ga.

[73] Assignee: The Coca-Cola Company, Atlanta, Ga.

[ * ] Notice: The portion of the term of this patent subsequent to Apr. 5, 2005 has been disclaimed.

[21] Appl. No.: 175,480

[22] Filed: Mar. 31, 1988

Related U.S. Application Data

[63] Continuation-in-part of Ser. No. 859,110, May 2, 1986, Pat. No. 4,735,321.

[51] Int. Cl.[4] ..... A47F 7/28

[52] U.S. Cl. ..... 206/597; 211/59.4; 211/74; 108/53.1; 108/56.1; 108/55.5; 108/55.1; 108/55.3; 100/2

[58] Field of Search ..... 206/386, 595, 596, 597, 206/598, 599, 600; 211/59.4, 74; 108/53.1, 56.1, 55.5, 55.1, 55.3; 100/2

[56] References Cited

U.S. PATENT DOCUMENTS

| | | | |
|---|---|---|---|
| 3,391,814 | 7/1968 | Box | 220/21 |
| 3,754,645 | 8/1973 | Kilroy | 206/597 |
| 3,917,066 | 11/1975 | Cloyd | 206/386 |
| 3,982,654 | 9/1976 | Goltsegen | 220/21 |
| 3,995,736 | 12/1976 | Lawson et al. | 206/386 |
| 4,000,704 | 1/1977 | Griffin, Jr. | 206/599 X |
| 4,037,722 | 7/1977 | Bremer | 206/523 |
| 4,162,738 | 7/1979 | Wright | 220/21 |
| 4,263,855 | 4/1981 | Lawlor | 108/53.3 |
| 4,344,530 | 8/1982 | DeLarosiere | 206/203 |
| 4,411,367 | 10/1983 | Bustos | 211/59.4 |
| 4,516,677 | 5/1985 | Rowland et al. | 206/394 |
| 4,567,981 | 2/1986 | Headon | 206/45.14 |
| 4,580,680 | 4/1986 | Wind | 206/386 |
| 4,653,651 | 3/1987 | Flum | 108/53.1 |
| 4,667,823 | 5/1987 | Wolfe, Jr. et al. | 206/597 X |
| 4,735,321 | 4/1988 | Day | 206/597 |

*Primary Examiner*—William Price

*Attorney, Agent, or Firm*—Thomas R. Boston; W. Dexter Brooks

[57] ABSTRACT

A mobile extra display module for storing, transporting, and displaying a quantity of containers, includes a plastic pallet base and a plurality of alternating layers of tier sheets and containers. The tier sheets have a top surface with an array of top recesses for receiving container bottoms, and a bottom surface with an array of bottom recesses for receiving container tops. The containers in each layer are in contact with adjacent containers. For storage and transportation purposes, the display module is made as a package unit including a rigid lid and a pair of straps extending around the unit, over the lid and under the base and being under a high force of about 100 pounds for holding the display module unit in a very strong and stable arrangement. This invention also includes an improved plastic pallet.

4 Claims, 11 Drawing Sheets

MOBILE EXTRA DISPLAY MODULE

CROSS-REFERENCE TO RELATED APPLICATION

This is a continuation-in-part of co-pending U.S. patent application Ser. No. 06/859,110, filed on May 2, 1986, now U.S. Pat. No. 4,735,321 with the same title, inventor and assignee as the present application.

BACKGROUND OF THE INVENTION

1. Field of the Invention

This invention relates to a packaging, distribution and display system for a quantity of containers, such as the well-known two liter plastic soft-drink bottles.

2. Description of the Prior Art

In retail stores, beverage bottles are displayed for easy access by customers on permanent shelves. The bottles are brought into the store in the corrugated boxes in which they are transported in the delivery truck. Alternatively, the bottles are stacked in an extra display stand at one end of a row of shelves with a thin sheet of material placed between each layer of bottles. Such extra displays suffer from numerous disadvantages including: the amount of labor required to arrange the display, the fact that the display cannot be moved, the unattractive appearance of the display, and the structural instability of the display stack. U.S. Pat. No. 4,567,981 shows a mobile extra display module.

Regarding the improved pallet of this invention, standard wooden pallets are well known.

SUMMARY OF THE INVENTION

The present invention comprises a mobile extra display system including a pallet base and a plurality of alternating layers of bottles and tier sheets. This display module is preferably automatically built in a bottling plant at the end of a bottling line, as a packaged display module unit for storage and/or transporting, and including a rigid lid and a plurality of straps extending vertically around the display module unit over the lid and under the base and tightly holding all of the bottles in-between the lid and the base. Such a packaged unit is preferably built with two such units on a square 36″×36″ wood pallet and strapped to the wood pallet for storage and stacking. Such units can be stacked three high in the warehouse. The display modules can then be transported to the retail store either as complete, packaged storage units, or the units can be disassembled at the warehouse for transporting as individual display modules. A first set of straps holds the packaged display module unit to its base, and a second, separate set of straps, perpendicular to the first set, is used when securing a pair of packaged display unit modules together on a wood pallet. In either event, after a packaged display module unit has been properly positioned in a retail store, the straps and the lid are removed. The lid, tier sheets and base are returned to the bottling operation for re-use.

It is an object of the present invention to provide an inexpensive, portable, attractive, safe and stable stack display system for containers.

It is a further object of the present invention to provide such a system that can be easily manufactured at the plant and that can be stacked two units wide and three pairs of units high in the plant.

It is another object of the present invention to provide an especially attractive mobile extra display module which also has improved handling, storage and safety features.

It is another object to provide a display module unit that can be tilted without breaking open.

It is a further object of this invention to provide an improved pallet that is stronger, will last longer than a standard wood pallet, and is flexible so as to be less susceptible to damage than a wood pallet.

BRIEF DESCRIPTION OF THE DRAWINGS

The present invention will be more fully understood from the detailed description below when read in connection with the accompanying drawings wherein like reference numerals refer to like elements and wherein.

DETAILED DESCRIPTION OF THE PREFERRED EMBODIMENT

Figure 1:
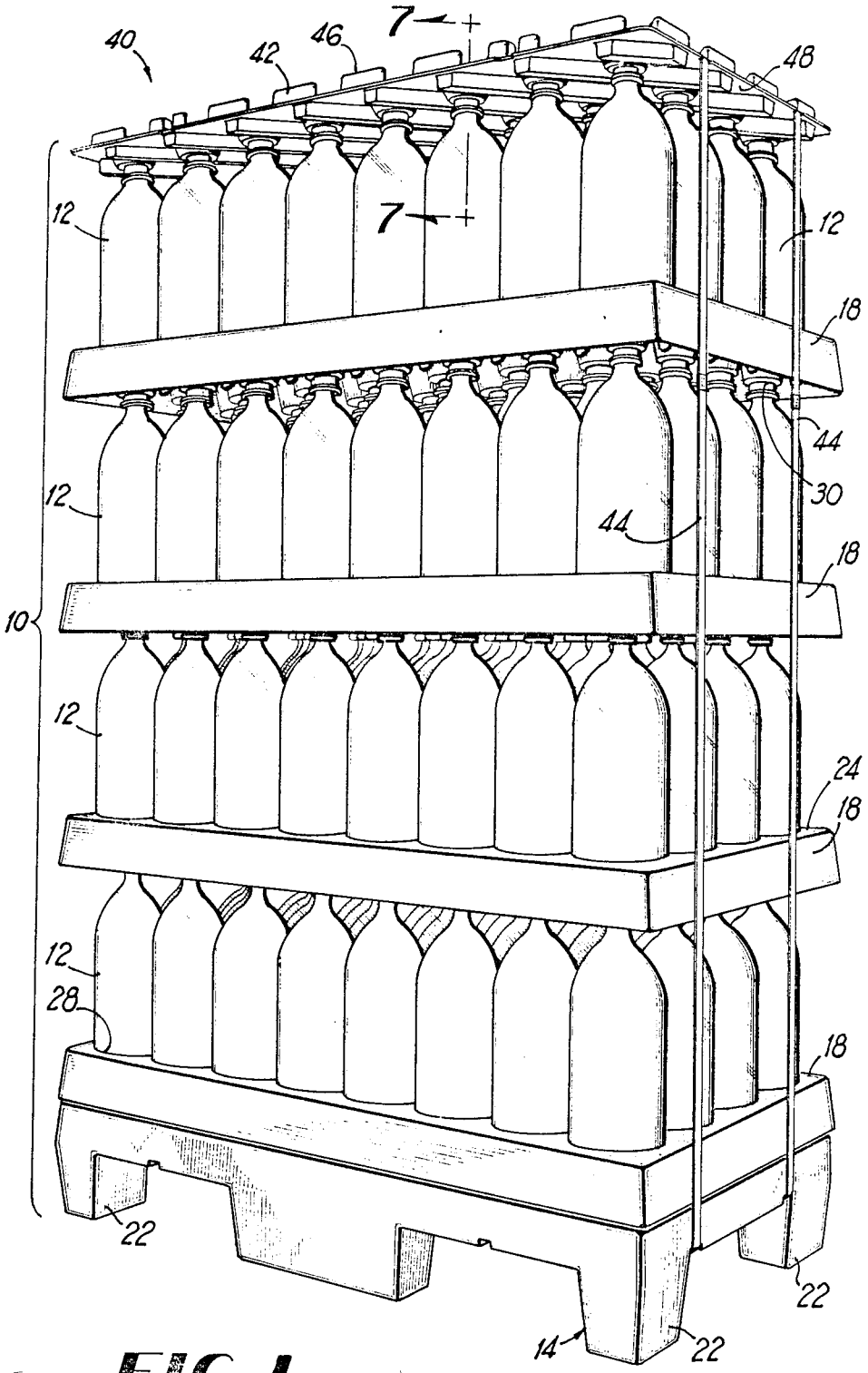
FIG. 1 is a perspective view of the packaged mobile extra display module unit of the present invention.
Figure 2:
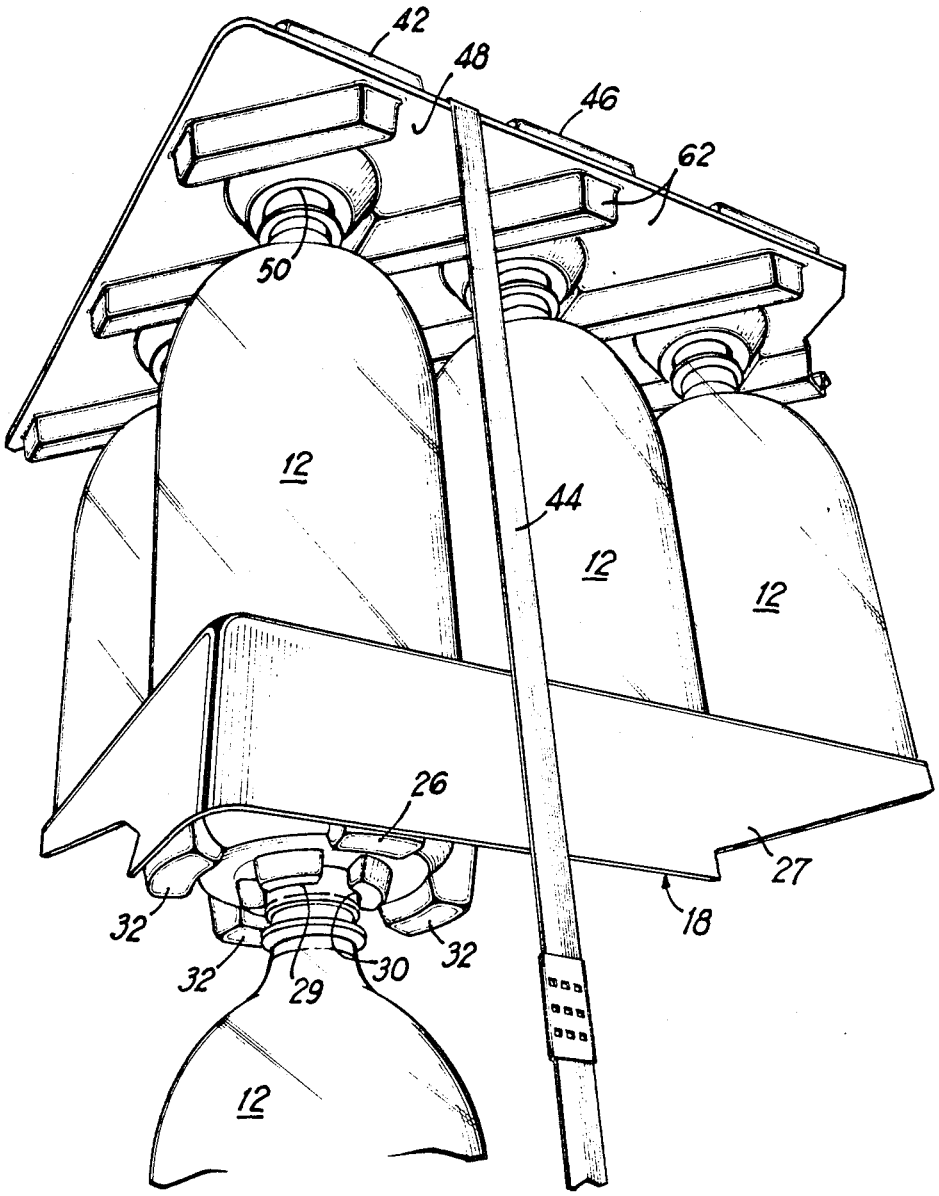
FIG. 2 is a fragmentary perspective view of the top portion of the display module unit FIG. 1.
Figure 3:
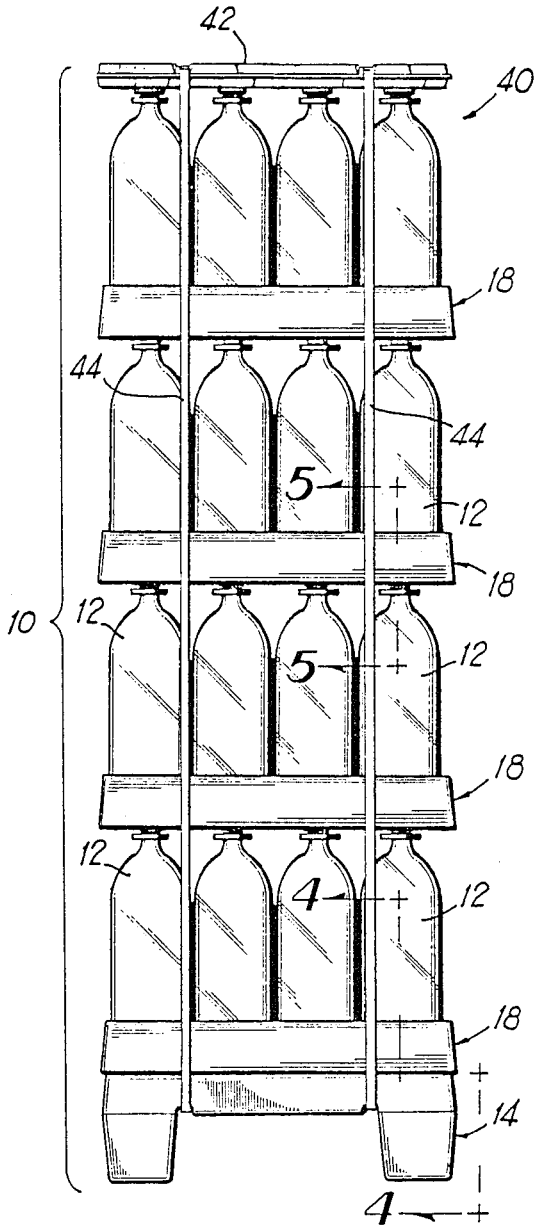
FIG. 3 is a side elevational view of the mobile extra display module unit of FIG. 1.
Figure 4:
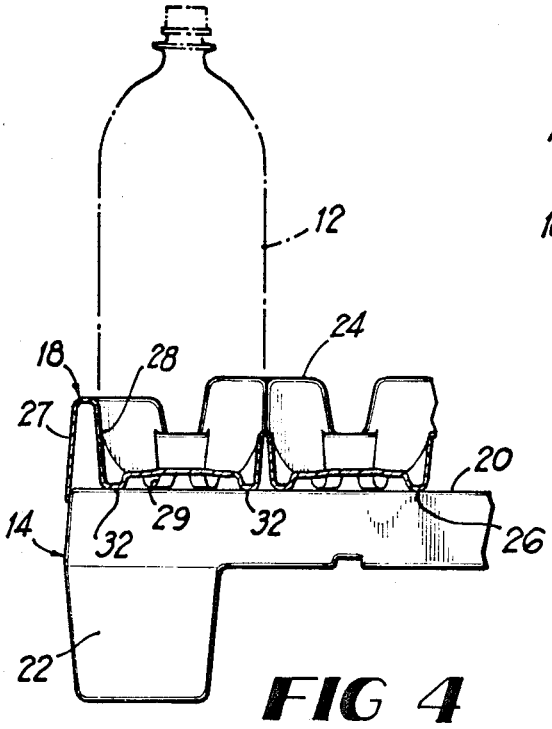
FIG. 4 is a partial cross-sectional view of the unit of FIG. 3 taken along line 4—4 of FIG. 3.
Figure 5:
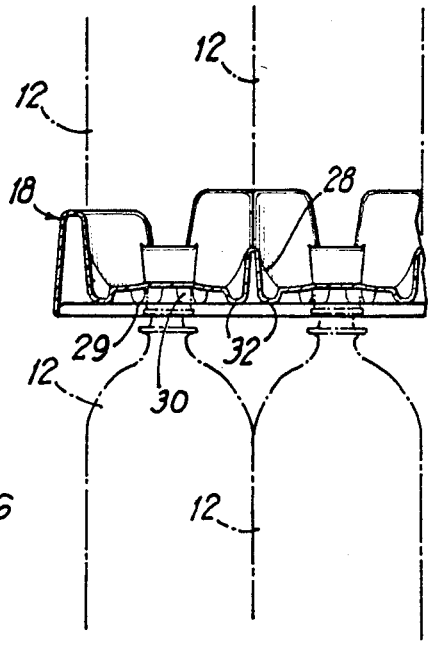
FIG. 5 is a partial cross-sectional view of the unit of FIG. 3 taken along line 5—5 of FIG. 3.
Figure 6:
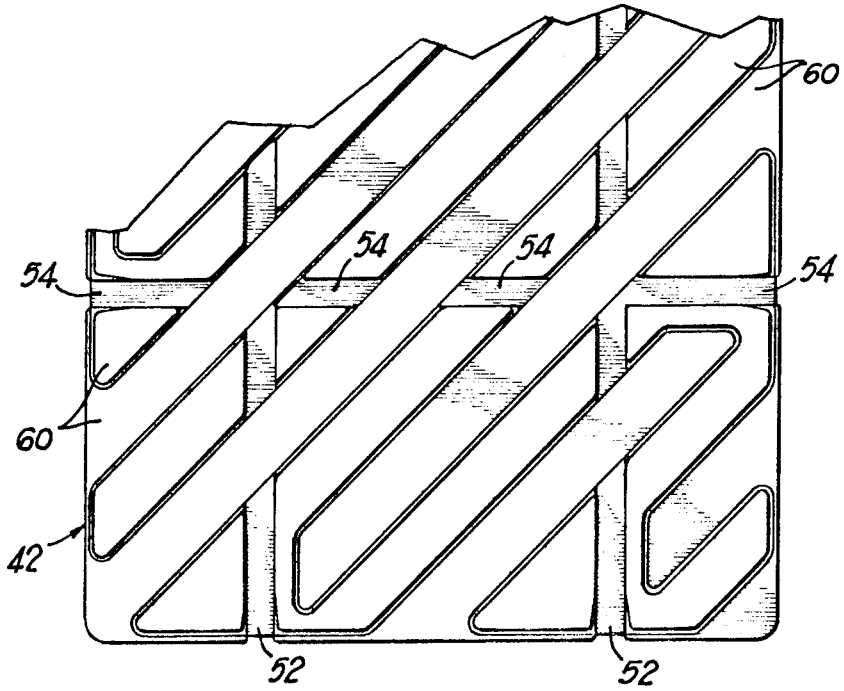
FIG. 6 is a partial top plan view of the lid used in FIG. 1.
Figure 7:
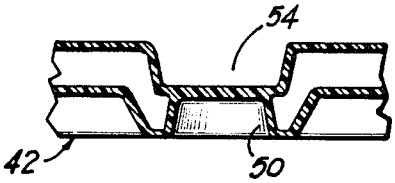
FIG. 7 is a partial cross-sectional view taken along line 7—7 of FIG. 1.

With reference now to the drawings, FIGS. 1–8 show a mobile extra display module 10 for containers 12, such as the typical, well-known, two liter PET beverage bottle, according to the present invention. The display module 10 includes a base 14, and a plurality of alternating layers of containers 12 and tier sheets 18.

The base 14 includes a flat top surface 20 (see FIG. 4) and six legs 22 arranged so that the base 14 can be used as a pallet with a pallet jack.

The tier sheets 18 each have a top surface 24, a bottom surface 26, and a circumferential skirt 27 therearound. The top surface 24 includes a rectangular array of top recesses 28 for receiving container bottoms. The bottom surface 26 includes a rectangular array of bottom recesses 30 for receiving container tops. The bottom surface 26 also includes a plurality of legs 32 around a border 29 surrounding each bottom recess 30. The legs 32 extend below the border 29, and have a distal end that is above the bottom edge of the skirt 27. The purpose of the legs is for use in spreading the weight of the display module on the base 14, by the lowermost tier sheet 18. The bottom recesses 30 are concentric to the top recesses 28. The top recesses 28 are preferably tangential to each adjacent recess so that the containers 12 are in contact. It is found that this provides additional strength and stability to the display module 10.

The base 14 is preferably slightly tapered along its side wall so that the lower edge of the bottom tier sheet fits tightly against the base to provide for both improved stability and appearance.

The display module 10 is shown in FIG. 1 as it is packaged as a display module unit 40 for storage and transportation. The display module unit 40 includes the display module 10 plus a lid 42 and straps 44. The lid is a rigid member having a top surface 46 and a bottom surface 48. The bottom surface 48 includes a rectangular array of bottom recesses for receiving container tops. The top surface 46 includes a first pair of parallel, strap-receiving grooves 52 extending longitudinally of the lid 42, and a second pair of parallel, strap-receiving grooves 54, extending perpendicular to the grooves 52.

The straps for a single unit 40 are placed around the unit 40 over the lid 42 and under the base 14, using the grooves 52. The straps are applied under sufficient force to hold the unit 40 as a very rigid stable arrangement. The straps 44 are preferably under a force of approximately 100 pounds. The straps 44 can be applied using standing metal strapping techniques. The straps 44 are preferably made of polyurethane.

Figure 8:
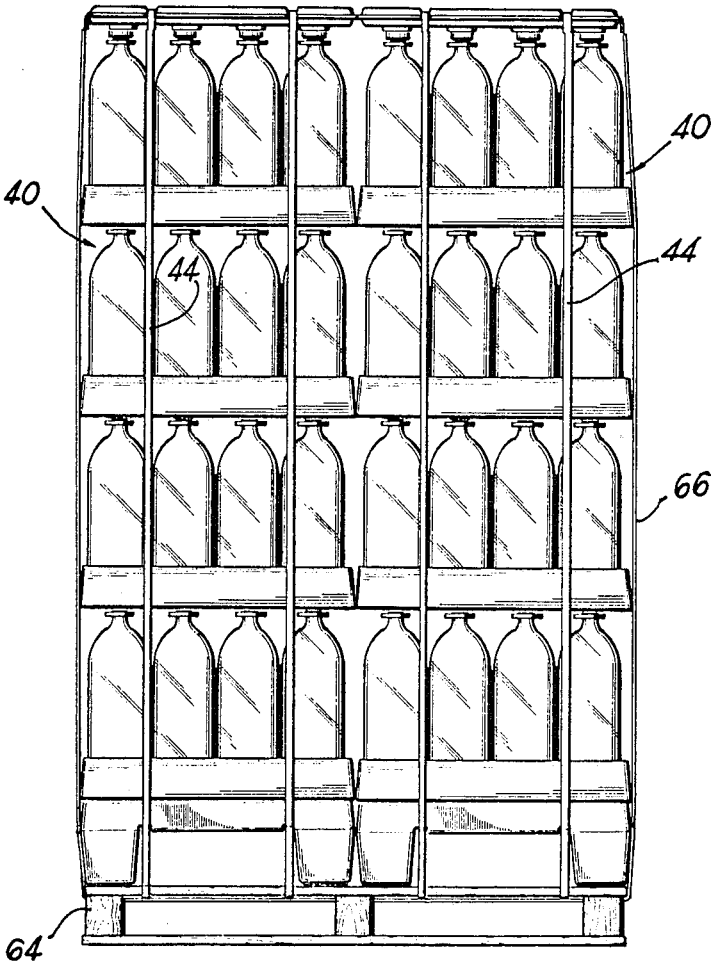
FIG. 8 is a side elevational view showing two display module units attached to a wood pallet.

For stacking the units 40 in a warehouse, two units 40 are placed on a single wood pallet 64 as shown in FIG. 8 and strapped thereto by straps 66 running over the lids, through the grooves 54, and running through the wood pallet. The double units can be stacked three high in a warehouse. The double units can be moved from a warehouse to a delivery trailer and transported to a retail store as such a double unit. Alternatively, the straps that hold the double unit together can be removed at the warehouse, along with the wooden pallet, and the single units 40 can be transported to the retail store. Once at the store, the unit 40 is transported to its desired location in the store, such as by use of a pallet lift. The straps 44 are then removed, along with the lid 42, leaving the attractive and stable display module 10.

The lid 42 must be rigid, so that it will not bend under the high force put on the straps 44. To that end, the lid 42 is preferably made of separate top and a bottom sheets, bonded together. The sheets are preferably made of plastic by blow molding. For added strength, each sheet has a plurality of alternating, parallel, ridges and grooves 60, with the ridges and grooves in the bottom sheet being perpendicular to those in the top sheet. The display module unit 40 can be tilted, such as during handling in the warehouse and during transporting on a slanted trailer floor or as the unit may be accidentally tilted during a quick stop, without breaking open, due to the rigid lid and tight force of the straps. This prevents bending of any of the tier sheets and its consequence of bottles coming loose.

The legs of the base 14 can have flat side surfaces or can have a vertical groove in each such side surface, for providing additional strength. The hollow inside of the base and its legs can be filled with a plastic foam for additional strength.

Another embodiment of this invention will now be described with reference to FIGS. 9–17. FIGS. 9–17 show a mobile extra display module 110 for containers 12, such as the typical, well-known, two liter PET beverage bottle. The display module 110 includes a base 114, and a plurality of alternating layers of containers 12 and tier sheets 118.

The base 114 includes a flat top surface 120 (see FIG. 18) except for certain recesses 102 as will be described below and six legs 122 arranged so that the base 114 can be used as a pallet.

The tier sheets 118 each have a top surface 124, a bottom surface 126, and a circumferential skirt 127 therearound. The top surface 124 includes a rectangular array of top recesses 128 for receiving container bottoms. The bottom surface 126 includes a rectangular array of bottom recesses 130 for receiving container tops. The bottom recesses 130 are concentric to the top recesses 128. The top recesses 128 are preferably tangential to each adjacent recess so that the containers 12 are in contact. It is found that this provides additional strength and stability to the display module 110.

The base 114 is preferably slightly tapered along its side wall so that the lower edge of the bottom tier sheet fits tightly against the base to provide for both improved stability and appearance.

Figure 9:
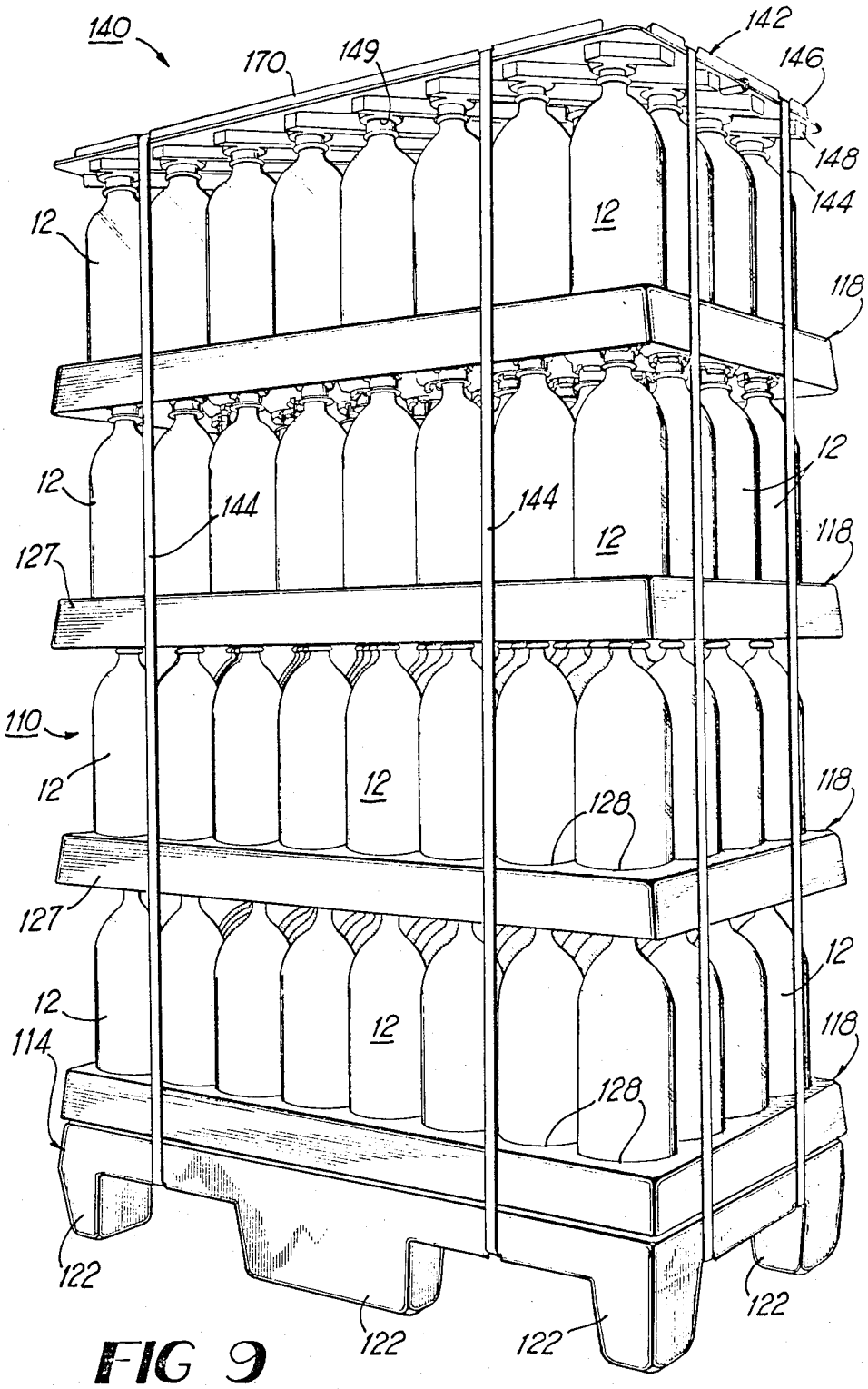
FIG. 9 is a perspective view of another embodiment of the packaged mobile extra display module of the present invention.
Figure 10:
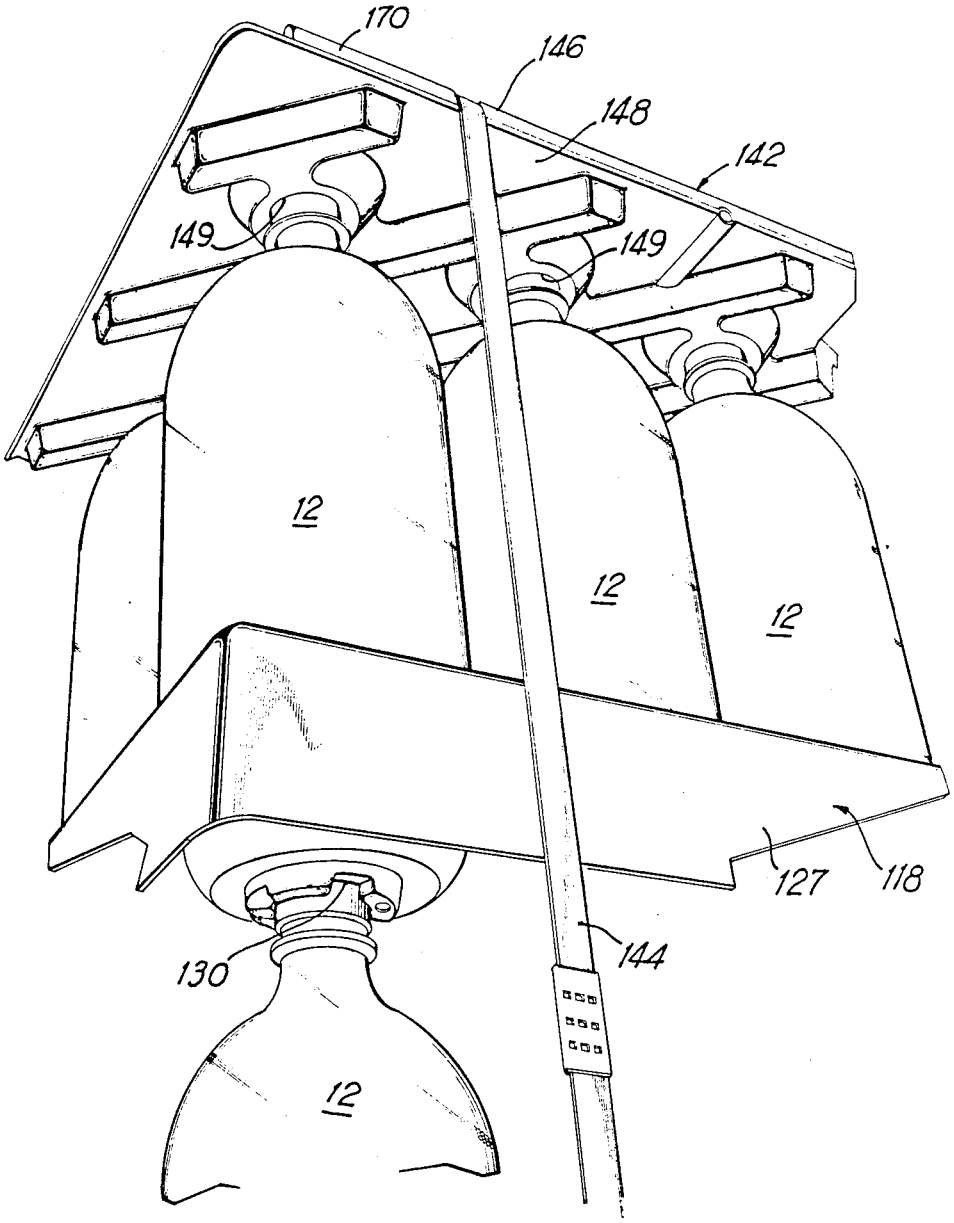
FIG. 10 is a fragmentary perspective view of the top portion of the display module of FIG. 9.
Figure 11:
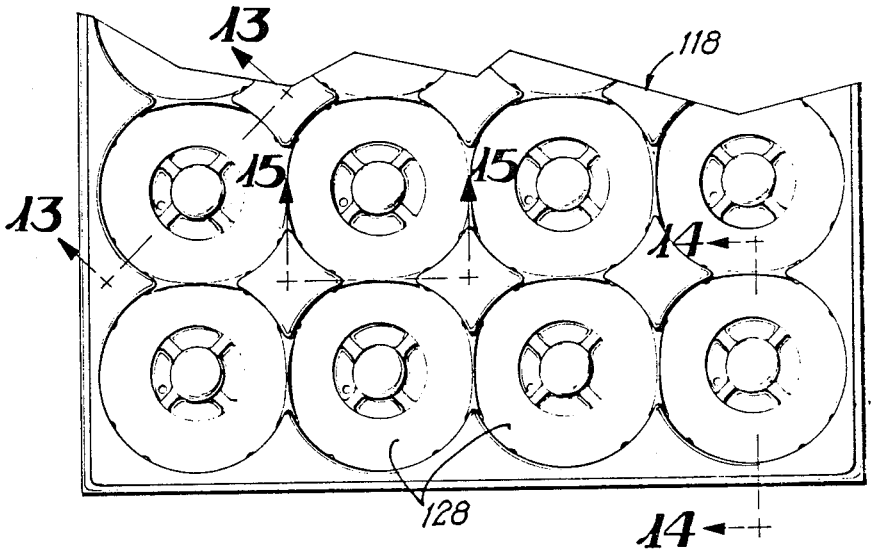
FIG. 11 is a plan view of the top of a tier sheet used in the module of FIG. 9.
Figure 12:
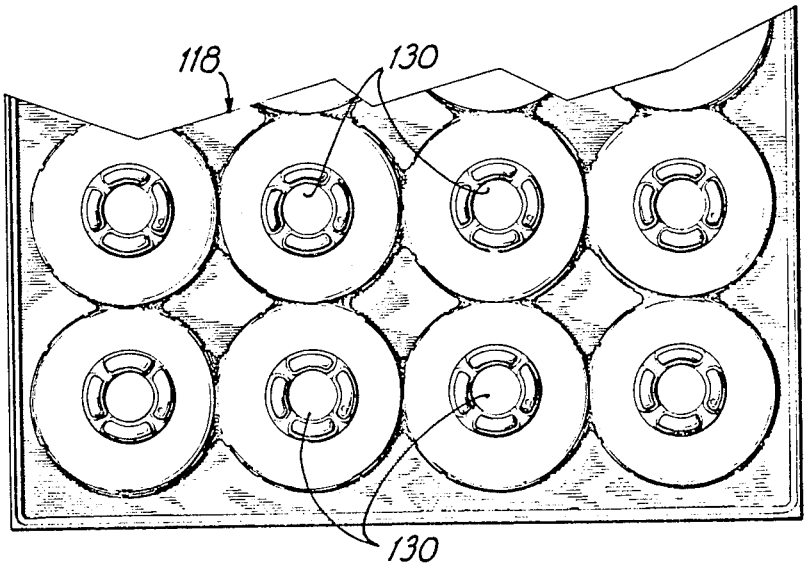
FIG. 12 is a plan view of the bottom of the tier sheet of FIG. 11.
Figure 13:
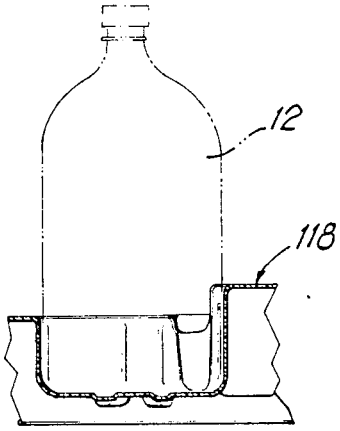
FIG. 13 is a partial cross-sectional view of FIG. 11 taken along line 13—13.
Figure 14:
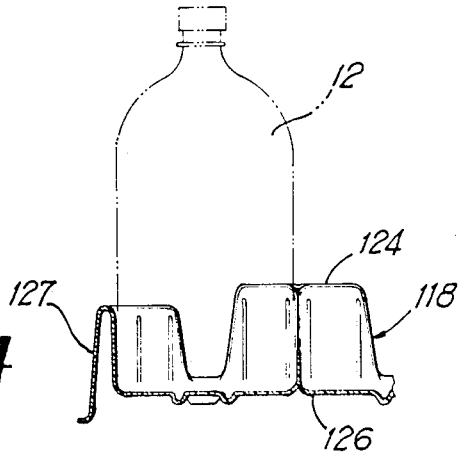
FIG. 14 is a partial cross-sectional view of FIG. 11 taken along line 14—14.
Figure 15:
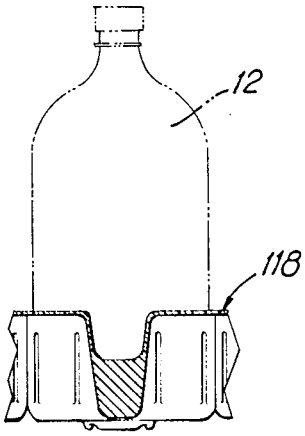
FIG. 15 is a partial cross-sectional view of FIG. 11 taken along line 15—15.
Figure 16:
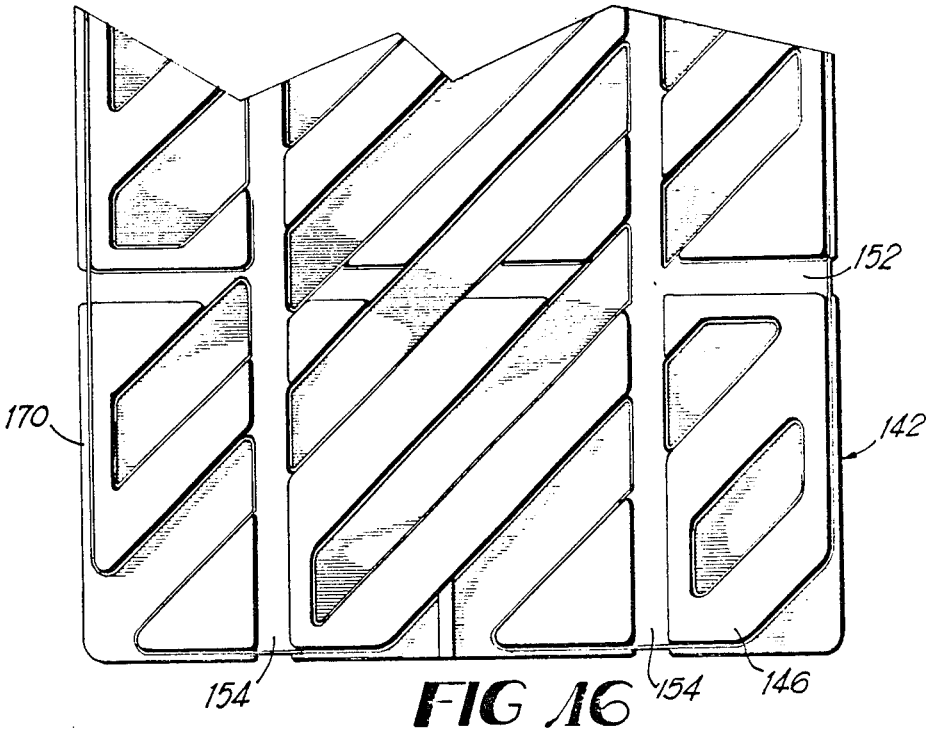
FIG. 16 is a top plan view of the lid used in the module of FIG. 9.
Figure 17:
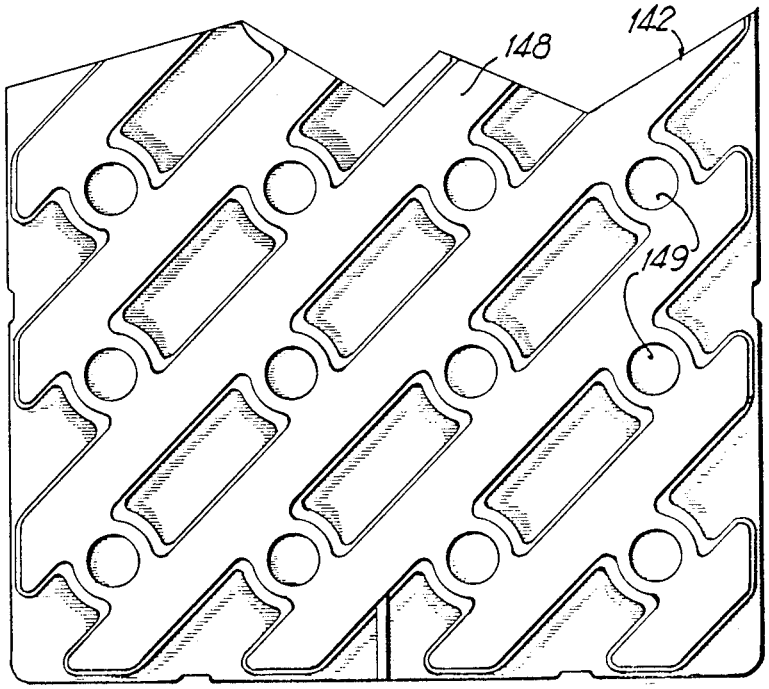
FIG. 17 is a bottom plan view of the lid of FIG. 16.

The display module 110 is shown in FIG. 9 as it can be packaged as a display module unit 140 for storage and transportation. It can be alternatively be packaged using stretch wrap and without the straps. The display module unit 140 includes the display module 110 plus a lid 142 and straps 144. The lid is a rigid member having a top surface 146 and a bottom surface 148. The bottom surface 148 includes a rectangular array of bottom recesses 149 for receiving container tops. The top surface 146 includes a first pair of parallel, strap-receiving grooves 152 extending longitudinally of the lid 142, and a second pair of parallel, strap-receiving grooves 154, extending perpendicular to the grooves 152.

The straps for a single unit 140 are placed around the unit 140 over the lid 142 and under the base 114, using the grooves 152. The straps are applied under sufficient force to hold the unit 140 as a very rigid stable arrangement. The straps 144 are preferably under a force of approximately 100 pounds. The straps 144 can be applied using standing metal strapping techniques. The straps 144 are preferably made of plastic, such as polypropylene.

For stacking the units 140 in a warehouse, two units 140 are placed on a single pallet and stretch wrapped together on a master pallet. The double units can be stacked three high in a warehouse. The double units can be moved from a warehouse to a delivery trailer and transported to a retail store as such a double unit. Alternatively, the straps that hold the double unit together, if any, can be removed at the warehouse, along with the pallet, and the single units 140 can be transported to the retail store. Once at the store, the unit 140 is transported to its desired location in the store, such as by use of a pallet lift. The straps 144 are then removed, along with the lid 142, leaving the attractive and stable display module 110.

The lid 142 must be rigid, so that it will not bend under the high force put on the straps 144. The lid 142 is preferably made by blow molding. Alternatively, it can be made by twin sheet vacuum forming. For added strength, each sheet has a plurality of alternating, parallel, ridges and grooves 160, with the ridges and grooves in the bottom sheet being perpendicular to those in the top sheet. The display module unit 140 can be tilted, such as during handling in the warehouse and during transporting on a slanted trailer floor or as the unit may be accidentally tilted during a quick stop, without breaking open, due to the rigid lid and tight force of the straps. This prevents bending of any of the tier sheets and its consequence of bottles coming loose.

The legs of the base 114 can have flat side surfaces or can have a vertical groove in each such side surface, for providing additional strength. The hollow inside of the base and its legs can be filled with a plastic foam for additional strength.

Several differences between this embodiment of FIGS. 9–17 and that of FIGS. 1–8 are as follows. The lid 142 includes a ridge 170 substantially all the way around the edge thereof for added strength. In addition, the legs 32 on the bottom of the tier sheets 18 are omitted in FIGS. 9–17 because it was found that they were not necessary. The bottom of the base 114 is provided with pins 220 and ridges 222 (see FIG. 18) that can extend into mating grooves in the pallet 200 shown in FIG. 18 to prevent slipping and to provide additional rigidity and strength to the structure.

It is noted that the base 114 preferably has grooves 102 in its top surface, even though these are not used in the module 110. The purpose for these grooves 102 is for use in returning a number of bases 114 back to the bottler; that is, the bases 114 can be stacked on top of each other with the locator pins and locator ridges 220 and 222, respectively mating with the grooves 102 to help make the stack of bases more secure.

While FIG. 9 shows two sets of straps being used, it is preferred to just use the one set running longwise of the module. Preferably two modules are then secured together with stretch wrap and placed on a pallet, without any connection to the pallet. The pairs of modules can be stacked on top of each other, using the pallets. In shipping to a store, the separate pallets stay at the bottler, and the two bases are used as the pallet. While stretch wrapping is preferred, shrink wrapping can alternatively be used, as can the second set of straps, if desired.

Figure 18:
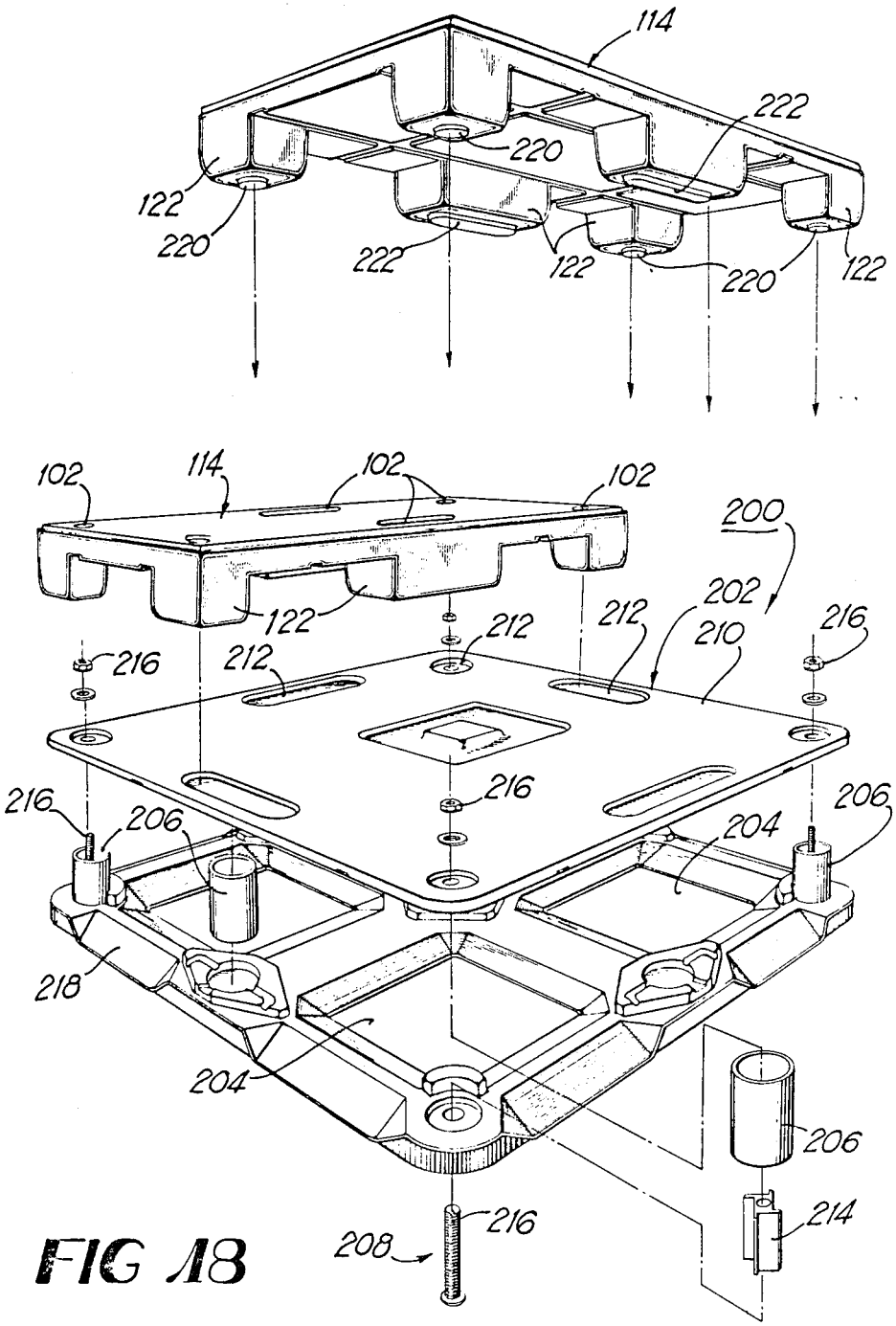
FIG. 18 is an exploded perspective view of the plastic pallet of the present invention.

The present invention also includes a plastic pallet 200 for the modules 10 and 110, which will now be described with reference to FIG. 18.

The pallet 200 includes a bottom sheet 202, a top sheet 204, a plurality of spacers 206 therebetween, and attaching means 208. The top surface 210 of the top sheet includes a plurality of recesses 212 positioned and shaped to receive the locator pins 220 and locator ridges 222. The recesses are located symmetrically such that the bases 114 can be placed on the pallet in either direction.

The spacers 206 are preferably hollow cylinders. The four spacers at the corners have the attachment means 208 therein, including a rigid support 214 that is a slip fit inside the hollow spacer, and a bolt and nut 216. The bottom sheet 204 has its side walls 218 beveled to assist the pallet jack entering into the pallet.

The four corner supports (the spacers 206 and supports 214) of the pallet 200 are built so strongly that they can withstand a direct hit by a fork lift at normal pallet entry speeds without damage. A major advantage of the pallet 200 is that one or preferably both of the sheets 202 and 204 are flexible so that if a pallet jack is improperly inserted and its wheels do not mate with the openings in the bottom sheet, that when it is jacked up to lift the load, the sheets can bend substantially as far as the pallet jack can be jacked up, without damage. When the operator then tries to move the load and can not, he will learn of the problem, but he will not have damaged the pallet 200 as he would have with prior rigid wood pallets. By having the middle spacers not being connected to the sheets 202 and 204, they simply fall out when the sheets bend or bow out; otherwise the bolts would be ripped out and damage the sheets. The spacers that fall out can be reinserted without damaging the pallet. The pallet 200 is also much more sturdy and longer lasting than a wooden pallet. The locator means, flexibility and extended life of the pallet 200 are substantial advantages over known pallets.

A pallet jack can move about four and one-half ($4\frac{1}{2}$) inches and it moves about one-half ($\frac{1}{2}$) inch before contacting the top sheet. Thus, according to this invention, one or preferably both sheets are sufficiently flexible to allow about four inches of movement or spreading or bowing apart without breaking.

While the preferred embodiment of this invention has been described above in detail, it is to be understood that variations and modifications can be made therein without departing from the spirit and scope of the present invention as set forth in the appended claims.

For example, while the display module 10 is shown for use with 2-liter plastic beverage bottles, other containers can be used, such as cans, bottles, etc. A rectangular array of containers has been shown along with a rectangular tier sheet, base and lid; however, other shapes such as circular and square shapes, as well as irregular shapes can be used. While the lid and base are preferably made of two pieces bonded together, other numbers of pieces, such as one, three, etc., can be used. While plastic is preferred, other materials can be used. While two straps are shown in each direction, other numbers and directions can be used.

I claim:

1. A method for providing a packaged display module unit for stacking, storing, transporting and displaying a quantity of containers having tops and bottoms, comprising the steps of:

(a) providing a pallet base having a flat top surface and a plurality of pallet legs;

(b) positioning a one-piece tier sheet on said base, said tier sheet having a top surface, a bottom surface and a circumferential skirt surrounding said tier sheet, said top surface having an array of container-bottom receiving top recesses, and a bottom surface having an array of container-top receiving bottom recesses concentric with said top recesses;

(c) positioning a layer of containers on said tier sheet with their bottom ends in said top recesses;

(d) positioning a second one of said tier sheets on top of said layer of containers, with the top ends of said containers in said bottom recesses of said second tier sheet;

(e) repeating steps (c) and (d) to build up a stack of alternating layers of containers and tier sheets;

(f) positioning a rigid lid on top of the top layer of containers, said lid having a top surface and a bottom surface, said bottom surface having an array of container-top receiving bottom recesses, and said lid top surface having a plurality of strap receiving grooves thereon; and (g) positioning a plurality of straps vertically around said display module unit and extending under said base and over said lid in said grooves of said lid, and tightening said straps with a force sufficient to hold said display module unit rigid, said lid having sufficient rigidity to remain flat and to resist bending under the force of said straps.

2. The method as recited in claim 1 wherein said base is made of plastic and including the step of positioning a pair of said display module units on a single pallet and strapping said pair of display modules to said pallet with straps running through said grooves.

3. A display module unit for stacking, storing, transporting and displaying a quantity of containers having tops and bottoms, comprising:

(a) a pallet base having a plurality of legs;

(b) a plurality of layers of one-piece tier sheets alternating with a plurality of layers of containers positioned on said base with a tier sheet positioned in contact with said base;

(c) each of said tier sheets being identical and having a top surface, a bottom surface, and a circumferential skirt surrounding said tier sheet, said top surface having an array of container bottom receiving top recesses, and a bottom surface having an array of container-top receiving bottom recesses, concentric with said top recesses;

(d) a rigid lid on top of the top layer of containers, said lid having a top surface and a bottom surface, said bottom surface having an array of container-top receiving bottom recesses, and said lid top surface having a plurality of strap receiving grooves therein; and (e) a plurality of straps extending vertically around said display module unit and extending under said base and over said lid in said grooves thereof, said straps having a tightening force thereon sufficient to hold said display module unit rigid, and said lid having sufficient rigidity to remain flat and resist bending under the force of said straps.

4. The apparatus as recited in claim 3 including a pair of said units on a pallet positioned underneath said pair of display module units and including a plurality of straps connecting the pair of display module units to said pallet and extending underneath said pallet and over said lid through said grooves.

* * * * *